United States Patent [19]

Mounce et al.

[11] 4,185,552

[45] Jan. 29, 1980

[54] MINE FIRING CONTROL SYSTEM

[75] Inventors: Whitman D. Mounce, Houston, Tex.; Ralph W. Mann, Washington, D.C.

[73] Assignee: The United States of America as represented by the Secretary of the Navy, Washington, D.C.

[21] Appl. No.: 594,133

[22] Filed: May 16, 1945

[51] Int. Cl.[2] ..... F42B 22/26

[52] U.S. Cl. ..... 102/18 M

[58] Field of Search ..... 102/16, 18, 70.2

[56] References Cited

U.S. PATENT DOCUMENTS

| | | | |
|---|---|---|---|
| 1,382,374 | 6/1921 | Maxim | 102/18 |
| 2,261,815 | 11/1941 | Thompson | 250/27 |
| 2,406,870 | 9/1946 | Vacquier | 102/18 |

OTHER PUBLICATIONS

Reich; "Theory & Application of Electron Tubes", Second Edition, 1944, pp. 353–357.

*Primary Examiner*—Charles T. Jordan

*Attorney, Agent, or Firm*—R. S. Sciascia; A. L. Branning

EXEMPLARY CLAIM

1. In a mine firing control system of the character disclosed, the combination of a mine firing control circuit including a plurality of electron discharge devices each of which is adapted to be rendered conducting when the bias voltage thereon is elevated to a predetermined value, circuit means including a first normally conducting electron discharge device for applying said bias voltage to said plurality of electron discharge devices, circuit means including a second normally non-conducting electron discharge device adapted to render said first electron discharge device non-conducting as said second electron discharge device is rendered conducting, means controlled by said mine firing control circuit for rendering said second electron discharge device conducting as the control circuit operates, and means for operating the control circuit.

17 Claims, 4 Drawing Figures

MINE FIRING CONTROL SYSTEM

Figure 1:
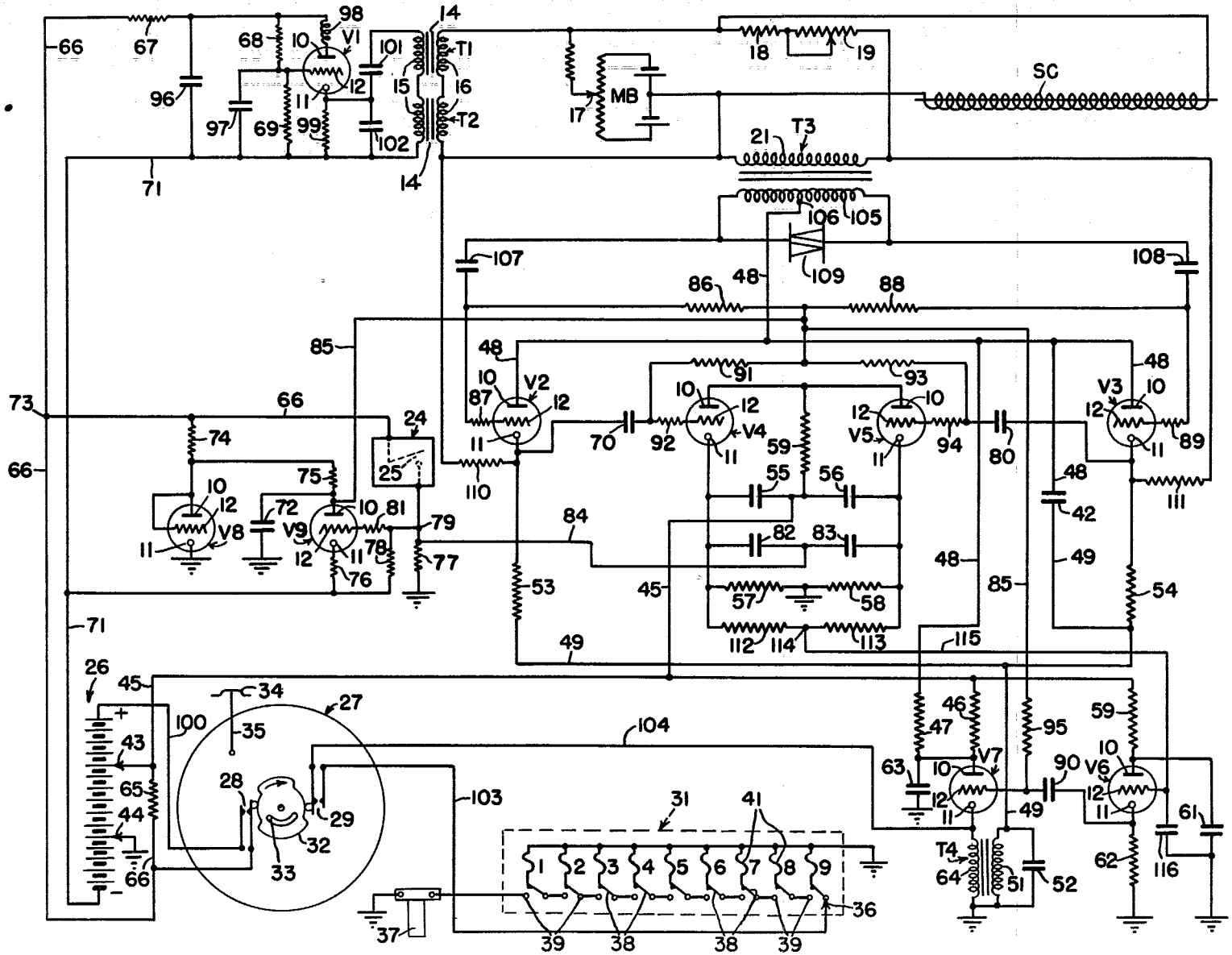

The invention herein described and claimed may be manufactured and used by or for the Government of the United States of America for governmental purposes without the payment of any royalties thereon or therefor.

This invention relates generally to electronic control circuits and more particularly to improvements in our copending application for Mine Firing Control System, Ser. No. 500,399, filed Aug. 28, 1943 now U.S. Pat. No. 3,722,409.

In the mine firing system of the aforesaid application, a control circuit comprising a plurality of electronic tubes is employed for causing the mine to be fired when a pair of small amplitude, low frequency signals of opposite polarity are received by the mine in predetermined time spaced relation from a vessel moving within the vicinity thereof, a magnetic amplifier being employed to convert the low frequency signals to electrical impulses of relatively short duration and of sufficient amplitude to initiate operation of the aforesaid control circuit which comprises a pair of paths or channels adapted to be operated selectively in accordance with the polarity of the electrical impulses applied thereto and adapted to coact in a manner to effect firing of the mine in accordance with the aforesaid time spaced relation of the signals.

A relaxation oscillator is employed for exciting the magnetic amplifier periodically, and time delay means under control of each of the aforesaid paths or channels is provided for rendering the oscillator ineffective for a predetermined interval of time after operation of either of the channels is initiated, thereby to prevent sweeping of the mine in response to signals received from an aircraft carried sweep, as an aircraft will pass from the vicinity of the mine within such interval.

Means is also provided for initiating operation of the aforesaid time delay means in response to countermine shocks received by the mine, thereby to prevent the magnetic amplifier from generating electrical impulses corresponding to signals resulting from countermine shocks during the aforesaid predetermined interval which also is of sufficient duration to permit the shocks to subside before the mine is restored to full responsiveness to signals received from a vessel moving with respect thereto.

Each of the channels, when operated, also is arranged to develop a voltage which gradually decreases in value, and a voltage divider network connected between the channels is employed to develop additively from the channel voltages thus developed, a voltage of sufficient amplitude to effect a complete operation of the control circuit and resultant firing of the mine when the time interval between operation of the channels is in accordance with the aforesaid time spaced relation of signals received by the mine.

The present invention contemplates improvements in the foregoing mine firing control system which render the electronic control circuit thereof more critically responsive to the amplitude and polarity of electrical impulses applied to the control channels of the circuit by the magnetic amplifier associated therewith. An important object of the present invention, therefore, is to provide a control circuit which insures selective operation of the control channels thereof in accordance with the amplitude and polarity of electrical impulses applied thereto.

The present invention further contemplates improvements in the aforedescribed control circuit by the provision of a normally conductive gaseous discharge tube which serves as a voltage regulator to supply fixed bias potential to certain other gaseous discharge tubes of the control circuit. Another object, therefore, is to provide bias potential for the control circuit which is substantially independent of the supply voltage therefor.

A further object of the present invention is to provide a control circuit in which the voltage regulator tube thereof is rendered non-conducting for a predetermined interval of time in response to operation of either of the control channels or in response to operation of means responsive to countermine shock, thereby to render the control circuit unresponsive during said interval to signals received from an aircraft sweep or signals resulting from countermining operations.

An additional feature of the invention resides in the provision of ship counting means adapted to be operated in response to each complete operation of the control circuit and adapted to fire the mine after a predetermined number of vessels has moved past the mine, an additional object of the invention being to interpose between successive operations of the ship counting means a time delay corresponding approximately to the time between the movement of successive vessels past the mine, thereby to insure that each vessel is counted only once.

Figure 2:
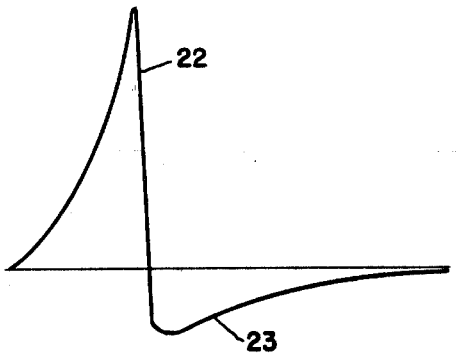
Figure 3:
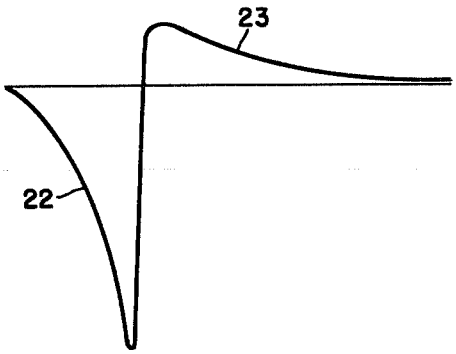
Figure 4:
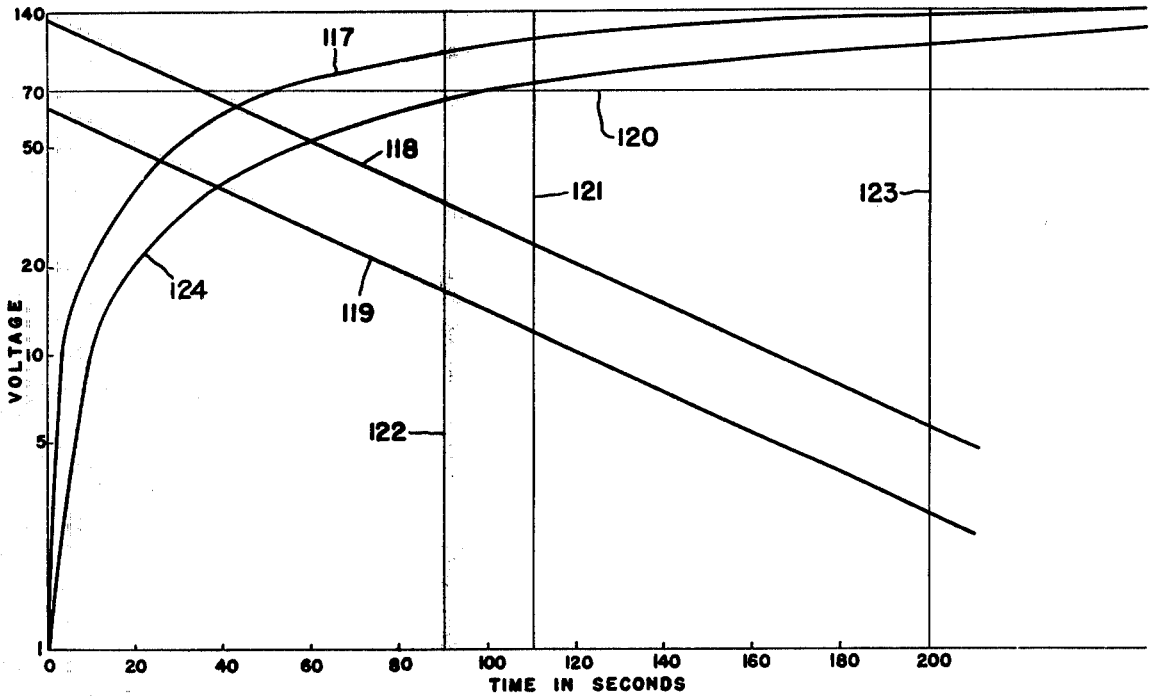

Still other objects, features and advantages of the invention, not specifically set forth hereinabove, are those inherent in or implied from the novel combination and arrangement of parts as will become more clearly apparent as the description proceeds, reference being had to the accompanying drawings in which:

FIG. 1 diagrammatically illustrates a mine firing control system according to a preferred embodiment of the invention;

FIGS. 2 and 3 illustrate the wave form of electrical impulses generated by the magnetic amplifier of the system in response to signals of opposite polarity received from a vessel moving with respect to the mine; and FIG. 4 is a group of curves illustrating the timing operations of the control circuit of the system.

Referring now to the drawings for a more complete understanding of the invention, it will be seen that the mine firing control system comprises a plurality of electronic tubes generally designated V1 through V9. These tubes preferably are of the "cold" cathode gaseous discharge type, each of the tubes comprising a main anode 10 and a cathode 11 which defines a main discharge gap with the anode and a control anode or grid 12 which defines a control gap with the cathode. As is well known, such tubes may be rendered conductive when a voltage equal to the breakdown potential of the control gap is applied between the control anode and cathode and a voltage of like value is applied between the main anode and cathode, this voltage being of considerably less value than the breakdown potential of the main gap. Thus, the control anode or grid, upon application of sufficient potential thereto, may be employed to trigger a flow of current through the main gap and cause the tube to glow or arc depending on the value of the current discharged therethrough, the tube being caused to glow when the current discharge is of low value and characterized principally by ionization effects and secondary emission effects, and the tube being caused to arc when the current discharge is of high value and is characterized principally by secondary emission and by a high order of thermionic emission caused by positive ion bombardment. It has been discovered that the sensitivity of the tubes is affected by arcing thereof. Accordingly, as will appear more fully hereinafter, such of the tubes which control the response and and complete operation of the control circuit are caused to glow rather than arc.

Tube V1 and the circuit elements associated therewith are employed as a relaxation oscillator which, together with a pair of toroids T1 and T2, a magnetic bias network MB and a transformer T3, comprises a magnetic amplifier which is disclosed and claimed in the copending application of Gustaf W. Elmen et al for MAGNETIC AMPLIFIER, Ser. No. 600,629, filed June 20, 1945. It will suffice, therefore, for purposes herein, merely to point out general features of the magnetic amplifier.

Each of toroids T1 and T2 comprises a toroidal core 14 having primary and secondary windings 15 and 16 respectively wound thereabout. The primary windings 15 of the toroids are connected in series so as to be excited by the same impulse received from the relaxation oscillator which is adapted periodically to supply impulses of sufficient amplitude to saturate the cores 14 of the toroids. The secondary windings 16 of the toroids are connected in series opposing such that the voltages respectively induced therein substantially cancel when the cores 14 are equally magnetized by the common current pulse flowing in primary windings 15. For this purpose, toroids T1 and T2 are matched as closely as engineering practice will permit, it being understood that small differences in the electrical and magnetic characteristics of the toroids produce unbalanced voltages in the secondary windings.

The magnetic bias network MB is employed to compensate for slight differences in the magnetic characteristics of the toroids and serves to supply a small D.C. current through the secondary windings in either direction selectively in accordance with the adjustment of the wiper of potentiometer 17 to either side of the center of the resistance coil thereof. The D.C. current thus caused to flow in the secondary windings produces magnetizing forces which magnetically bias the cores of the two toroids in opposite directions sufficiently to balance or cancel subsantially any difference in the voltages generated by the secondary windings by reason of any dissimilarities in the cores or windings of the toroids.

An induction pickup or search coil SC comprising a relatively large number of turns of wire arranged about an elongated magnetic core is caused to generate small amplitude, low frequency electrical currents of opposite polarity selectively in accordance with increases and decreases in the strength of the magnetic field in the vicinity of the search coil as controlled by the magnetic signature of a vessel moving with respect thereto. The currents generated by the search coil are caused to flow through the secondary windings 16 of toroids T1 and T2 in the same manner that currents from the magnetic bias network MB are caused to flow therethrough and thus the search coil currents similarly produce changes in the magnetic bias of the cores as heretofore described.

By reason of the extremely nonlinear magnetic characteristics of the cores, a relatively small change in the magnetic bias thereof from that which produces substantially no voltage across the combined secondary windings causes a relatively large difference in the rate of change of flux in one core relative to the other whereby an unbalanced voltage of relatively great amplitude proportional to the magnitude of the change in magnetic bias and of polarity corresponding to the polarity of the current producing the magnetic bias is developed across the combined secondary winding, a relatively small change in magnetic bias thus producing an unbalanced voltage of relatively large value. The magnetic amplifier thus serves to convert the low amplitude, low frequency search coil currents to voltage impulses of short duration and relatively great amplitude and of polarity corresponding to the polarity of the search coil currents.

The unbalanced voltage, depending on the polarity thereof, causes a current impulse to flow in either direction through an obvious circuit including resistor 18, adjustable resistor 19 and primary winding 21 of transformer T3, the adjustable resistor 19 being employed to control the sensitivity of the magnetic amplifier. The voltage impulse appearing across primary winding 21 of transformer T3, in either case, has a wave form which conforms substantially to that shown in either FIG. 2 or 3, these wave forms corresponding to voltage impulses which are of opposite polarity but otherwise are substantially identical in every respect. The voltage impulses are transient in character, each comprising a leading portion 22 which rises sharply to a peak of relatively great amplitude and thereafter decreases abruptly, and a trailing or rounded tail portion 23 of relatively small amplitude and of opposite polarity.

Tubes V2 and V4 together with the circuit elements associated therewith comprise one of the channels of the control circuit which is adapted to render tube V9 conductive and to apply a gradually decreasing bias to the grid of tube V6 when operation of the channel is initiated by the application of a voltage impulse of proper amplitude and polarity thereto. Tubes V3 and V5 together with the circuit elements associated therewith comprise the other channel of the control circuit which similarly is adapted to render tube V9 conductive and to apply a gradually decreasing bias to the grid of tube V6 when operation of this channel is initiated in response to the application of a voltage impulse of proper amplitude and polarity thereto.

Tube V6 together with the circuit elements associated therewith is employed to render tube V7 conductive, tube V6, for this purpose being rendered conductive when sufficient bias is applied additively to the grid thereof by the control channels.

Tube V7 and the circuit elements associated therewith comprise the mine firing and ship counting circuit of the system, the current flow through tube V7, as will appear in greater detail hereinafter, first being utiized to effect a predetermined number of ship counting operations and thereafter being utilized to energize the mine firing circuit.

Tube V8 together with the circuit elements associated therewith is employed as a voltage regulator tube adapted to supply fixed bias potential to the control grids of tubes V2 through V5 and tube V7, tube V8, for this purpose, being normally conductive.

Tube V9 and the circuit elements associated therewith comprise means for rendering tube V8 non-conductive when tube V9 is rendered conductive in response to operation of either of the control channels, or in response to operation of an anti-countermining mechanism generally designated by numeral 24. Mechanism 24 may be of any type suitable for the purpose such, for example, as the anti-countermine mechanism disclosed and claimed in the copending application of Seth W. Booth for Inertia Switch and Means Controlled Thereby, Ser. No. 484,854, filed Apr. 28, 1943, in which means responsive to shocks received by the mine are employed to close a normally open switch 25.

A multi-tap battery 26 is employed for applying various operating potentials to the several tubes of the system and for supplying the energy stored in certain of the condensers associated therewith, a clock mechanism generally designated by the numeral 27 and having a pair of switches 28 and 29 being employed for connecting the high potential side of the battery to certain of the aforedescribed circuits and for connecting a counting mechanism generally designated 31 to the control circuit when the mine is planted in a body of water. Clock mechanism 27 preferably is of the type disclosed in the copending application of James B. Glennon et al for Firing Mechanism for a Submarine Mine, Ser. No. 395,230, filed May 26, 1941, now U.S. Pat. No. 2,905,088, issued Sept. 22, 1959, in which a spring and escapement driven cam 32 is employed to close switches 28 and 29 in predetermined time spaced relation as the cam rotates in the direction of the arrow to engage a stop pin 33, operation of the clock mechanism being initiated by a suitable clock starter mechanism comprising a flexible diaphragm 34 which operates in response to pressure of the surrounding water to move a plunger 35 into a position to release the escapement of the clock.

Counting mechanism 31 comprises a plurality of switches generally designated 1 through 9 and an adjustable contact 36 settable into a plurality of different positions with respect to the switches whereby an electroresponsive detonator 37 is adapted to be connected to the aforesaid firing and ship counting circuit including tube V7 when a predetermined number of switches has been closed by the counting mechanism. Each of switches 1 through 9 comprises a contact spring 38 which normally is held out of engagement with its associated contact 39 by means of a fusable element 41, the contact spring being released to engage its associated contact when the fusable element is melted as a current of predetermined value is caused to flow therethrough.

With the various circuit elements connected as shown in FIG. 1, condenser 42 associated with the main gaps of tubes V2 and V3 charges to the potential between tabs 43 and 44 of battery 26 by way of tap 43, conductor 45, resistors 46 and 47, conductor 48, condenser 42, conductor 49, condenser 52 in parallel with secondary winding 51 of transformer T4, and thence by way of ground potential to tap 44 of battery 26. Thus, the potential across condenser 42 is applied across the main gap of tube V2 by way of conductor 48, plate 10 and cathode 11 of tube V2, resistor 53, and thence by way of conductor 49 to the opposite side of condenser 42. Similarly, the potential across condenser 42 is applied across the main gap of tube V3 by way of conductor 48, plate 10 and cathode 11 of tube V3, resistor 54, and thence by way of conductor 49 to the opposite side of condenser 42.

Condensers 55 and 56 associated with the main gaps of tubes V4 and V5 respectively also are charged to the potential between taps 43 and 44 of battery 26 by way of tap 43, conductor 45, condenser 55 and resistor 57 in parallel with condenser 56 and resistor 58, and thence by way of ground potential to tap 44 of battery 26. The potential thus developed across condenser 55 is applied across the main gap of tube V4 by way of a resistor 59, plate 10 and cathode 11 of tube V4 to the opposite side of condenser 55, and similarly, the potential developed across condenser 56 is applied by way of resistor 59 across the main gap of tube V5.

In like manner, condenser 61 associated with the main gap of tube V6 is charged to the potential between taps 43 and 44 of battery 26 by way of conductor 45, resistor 59, condenser 61 and thence by way of ground potential to tap 44 of the battery, the voltage across the condenser being applied across the main gap of tube V6 by way of plate 10 and cathode 11 of tube V6, resistor 62 and thence by way of ground potential to the other side of the condenser. Condenser 63 associated with the main gap of tube V7 also is charged to the potential between taps 43 and 44 of battery 26 by way of tap 43, conductor 45, resistor 46, condenser 63, and thence by way of ground potential to tap 44 of the battery, the voltage across condenser 63 being applied across the main gap of tube V7 by way of plate 10 and cathode 11 thereof, primary winding 64 of transformer T4, and thence by way of ground potential to the other side of condenser 63.

The value of the aforedescribed potential thus applied across the main gap of each of tubes V2 through V7 is less than the breakdown potential and greater than the sustaining voltage of the gap such that each of the tubes is caused to conduct when a potential of value equal to or greater than the breakdown potential of the control gap of each of the tubes is applied thereto, the potential across each of the control gaps, for such purpose, being supplied by fixed bias potential applied thereacross and/or potential applied thereto selectively or selectively and additively, as the case may be, as either of the control channels operates.

A voltage divider network is connected across battery 26 between tap 43 and the low voltage side thereof by way of tap 43, resistor 65, conductor 66, resistors 67, 68 and 69, and thence by way of conductor 71 to the low voltage side of the battery. Condenser 72 connected in parallel with the main gaps of tubes V8 and V9 is charged to the potential at point 73 in the aforedescribed voltage divider network by way of conductor 66, resistors 74 and 75, condenser 72, and thence to ground potential at tap 44 of battery 26. The voltage thus developed across condenser 72 is applied to the main and control gaps of tube V8 by way of resistor 75, plate 10 and cathode 11 in parallel with grid 12 and cathode 11 thereof, and thence by way of ground potential to the other side of condenser 72. This potential is less than the control gap breakdown potential of the tube, and the tube, therefore, does not conduct.

The potential across condenser 72 in series with the potential across battery 26 between tap 44 and the low voltage side thereof is applied across the main gap of tube V9 by way of plate 10 and cathode 11 thereof, resistor 76, and thence by way of conductor 71 to the low voltage side of the battery. The total potential, thus applied across the main gap of tube V9 is less than the main gap breakdown potential thereof and is greater than the main gap sustaining voltage thereof such that the tube is caused to conduct when a potential equal to or greater than the control gap breakdown potential of the tube is applied across the control gap thereof. This latter potential is supplied in part as fixed bias by way of a voltage divider network connected across battery 26 between tap 44 and the low potential side thereof by way of tap 44, ground potential at resistor 77, resistors 77 and 78, and thence by way of conductor 71 to the low potential side of the battery.

Point 79 in this divider network is connected to grid 12 of tube V9 by way of resistor 81, and the potential at this point in the network is elevated above the bias potential provided thereby to a value which equals or exceeds the control gap breakdown potential of the tube by the additional application to the grid thereof of one-half of the potential developed between the cathodes 11 of tubes V4 and V5 after either of these tubes is rendered conductive. This latter potential appears momentarily at the junction of a pair of identical condensers 82 and 83 which are connected in series between the cathodes 11 of tubes V4 and V5, the junction between these condensers being interconnected with point 79 by a conductor 84.

The voltage across condenser 72 is applied as fixed bias across the control gap of tube V2 by way of a conductor 85, resistors 86 and 87, grid 12 and cathode 11 of tube V2, resistor 53, conductor 49, condenser 52 in parallel with primary winding 51 of transformer T4, and thence by way of ground potential to the other side of condenser 72. Similarly, the voltage across condenser 72 is applied as fixed bias across the control gap of tube V3 by way of a conductor 85, resistors 88 and 89, grid 12 and cathode 11 of tube V3, resistor 54, conductor 49, condenser 52 in parallel with winding 51 of transformer T4, and thence by way of ground potential to the other side of condenser 72.

The potential across condenser 72 is also applied as fixed bias across the control gap of tube V4 by way of conductor 85, resistors 91 and 92, grid 12 and cathode 11 of tube V4, resistor 57, and thence by way of ground potential to the opposite side of condenser 72, condenser 70 being charged to this bias potential by way of resistor 53, conductor 49, winding 51 of transformer T4, and thence by way of ground potential to the other side of condenser 72. Similarly, the potential across condenser 72 is applied as fixed bias across the control gap of tube V5 by way of resistors 93 and 94, grid 12 and cathode 11 of tube V5, resistor 58, and thence by way of ground potential to the opposite side of condenser 72, condenser 80 being charged to this bias potential by way of resistor 54, conductor 49, winding 51 of transformer T4, and thence by way of ground potential to the opposite side of condenser 72. The potential across condenser 72 is further applied as bias potential across the control gap of tube V7 by way of conductor 85, resistor 95, grid 12 and cathode 11 of tube V7, primary winding 64 of transformer T4, and thence by way of ground potential to the opposite side of condenser 72, condenser 90 being charged to this bias potential by way of resistor 62 and thence by way of ground potential to the other side of condenser 72.

The bias potential thus applied to the control grid of each of tubes V2 through V4 and V7 is adapted to be elevated, after the mine is planted, to such a bias value that when additional potential is applied selectively to each of the grids of these tubes as the control circuit operates in response to signals received by the search coil SC, the tubes are rendered conductive, as will become more clearly apparent as the description proceeds. Resistor 65 in the voltage divider network connected between tap 43 and the low voltage side of battery 26 is employed as a means for maintaining the bias potential on conductor 85 at a relatively low value before the mine is planted, the potential on conductor 85 without the provision of resistor 65 otherwise being maintained at negative battery potential by way of conductor 71, resistors 69, 68 and 67, conductor 66, and thence by way of resistors 74 and 75 to conductor 85. Under such a condition, a potential difference would exist between the plate 10 and grid 12 of each of tubes V2 through V4 and V7 sufficient to break down the gap therebetween and cause these tubes to conduct, thereby producing a condition which might cause premature wearing of the tubes.

It will be noted that anti-countermining mechanism 24 is connected between conductor 66 and point 79 and, therefore, is adapted to supply the potential at plate 10 of tube V9 to the grid 12 thereof as switch 25 of mechanism 24 is operated in response to countermining shocks received by the mine.

Condenser 96 in the oscillator circuit charges to the potential across resistors 68 and 69 of the aforedescribed voltage divider network connected between tap 43 and the low voltage side of battery 26, and condenser 97 charges to the potential across resistor 69. The potential across condenser 96 is applied across the main gap of tube V1 by way of inductance coil 98, plate 10 and cathode 11 of tube V1, and thence by way of resistor 99 to the opposite side of condenser 96. Similarly, the potential across condenser 97 is applied across the control gap of tube V1 by way of control grid 12 thereof and thence by way of resistor 99 to the opposite side of condenser 97. The potentials thus applied to the control and main gaps of tube V1 are of insufficient value, however, to render the tube conductive.

As the mine is launched into a body of water, switch 28 of the clock mechanism 27 is the first to close, thereby to connect conductor 66 by way of switch 28 and conductor 100 to the high potential side of battery 26.

With the potential at point 73 thus elevated to full potential of battery 26, condenser 72 is caused to charge to such a value as to render tube V8 conductive, thereby to limit the potential rise of condenser 72 to the voltage drop across the main gap of the tube. The voltage drop across the main gap when current is flowing therethrough is commonly referred to as the main gap sustaining voltage of the tube and is approximately independent of the current flow therethrough. Also, the voltage drop across the control gap of the tube when current is flowing therethrough is commonly referred to as the control gap sustaining voltage of the tube and is approximately independent of the current flow therethrough. It is these properties which render the tube adaptable for use as a voltage regulator. Thus, the potential across condenser 72 and the bias potential provided thereby on conductor 85 is maintained substantially constant regardless of variations in the supply potential provided by battery 26.

Full battery potential on conductor 66 also causes condensers 96 and 97 to charge to such values that breakdown potential is applied across the control gap of tube V1, thereby rendering the tube conductive. As tube V1 is rendered conductive, condenser 96 discharges through the main gap thereof, the discharged current flowing through three parallel paths of which the first path comprises condenser 101 and primary windings 15 of toroids T1 and T2 and the second and third paths comprise condenser 102 and resistor 99 respectively. Resistance 99 is selected of sufficiently large value so as to limit the flow of current through tube V1 thereby to cause the tube to glow, it being important that the trigger potential of the tube be maintained substantially constant for the reason that a substantially constant frequency of oscillation of the tube such, for example, as three discharges of current therethrough per second is desired for the life of the mine. Moreover, the magnetic balance of toroids T1 and T2 depends upon the maintenance of a substantially constant excitation therefor, which excitation in turn is caused to increase and decrease as the trigger potential is increased and decreased respectively.

Current flow through tube V1 continues until the potential across condenser 96 is reduced to a few volts below the main gap sustaining potential of tube V1, inductance 98 serving to provide a sufficient "overshoot" in the discharge of condenser 96 to insure the extinction of the tube after each period of glow thereof. Condenser 97 and its associated resistor 69 maintain the breakdown potential across the control gap of V1 for an interval of time sufficient to insure breakdown of the main gap thereof.

The discharge of current through the primary windings 15 of toroids T1 and T2 is fairly rapid thus producing the sharp peak portion 22 of the signal impulses appearing at primary 21 of transformer T3, condenser 102 serving as a filter to smooth the peak. The relatively slower discharge of condenser 101 through resistor 99 produces the rounded tail portion 23 of the signal appearing at primary winding 21 of transformer T3.

Upon extinction of tube V1 condensers 96 and 97 again charge from battery 26 through resistors 67 and 68 respectively until breakdown potential is again applied across the control gap of the tube thereby to render the tube conductive, the RC constants of resistor 67 and condenser 96 and resistor 68 and condenser 97 being such as to cause tube V1 to be fired at the aforesaid frequency of three times per second.

Switch 29 of clock mechanism 27 is closed a predetermined interval of time after switch 28 thereof is closed thereby to connect wiper 36 of counting mechanism 31 to cathode 11 of tube V7 by way of conductor 103, switch 29 and conductor 104, thus placing the mine and the control circuit thereof in a condition to respond to signals received from a vessel moving with respect to the mine.

However, before applying the impulses of FIGS. 2 and 3 to the control circuit for the purpose of illustrating the manner in which the counting mechanism 31 and detonator 35 are operated in response to complete operations of the control circuit, the manner in which the impulses are applied selectively to tubes V2 and V3 of the control channels will first be considered.

The voltage impulses of FIGS. 2 and 3 which appear across primary winding 21 of transformer T3 also appear across the secondary winding 105 thereof, transformer T3 preferably being a step-up transformer whereby the amplitude of the impulses may be increased in accordance with the ratio of the primary and secondary windings, if desired. Center tap 106 of secondary winding 105 is connected to conductor 48, and the center tap, accordingly, under static potential conditions in the control circuit is maintained at the potential at tap 43 of battery 26. The opposite ends of secondary winding 105 are connected by way of condensers 107 and 108 to the bias circuits of tubes V2 and V3 respectively. Condensers 107 and 108, therefore, under static potential conditions are each charged to the difference in potential between the voltage at tap 43 on battery 26 and the bias potential on conductor 85.

Assuming the appearance of a voltage impulse across secondary winding 105 of such polarity that the left end of the winding as viewed in the drawing is rendered positive and the right end of the winding is rendered negative by such voltage impulse, the potential at the left end of the winding is elevated above the static potential at the center point 106 thereof, thereby to elevate the potential on the opposite side of condenser 107 sufficiently to apply breakdown potential across the control gap of tube V2 and thus render the tube conductive. The potential at the right end of transformer winding 105, however, is reduced below the static potential at center tap 106, thereby reducing the potential on the opposite side of condenser 108 and insuring that tube V3 will not be fired or tiggered in response to the assumed voltage impulse.

From the foregoing it will be seen that the potential on the grid of tube V3 is lowered to the same extent that the potential on grid 12 of tube V2 is elevated in response to a voltage impulse of the polarity assumed. A signal voltage impulse of sufficiently great amplitude, therefore, might render the potential on grid 12 of tube V3 sufficiently negative so as to apply breakdown potential between plate 10 and the grid 12 thereof and thereby render the tube conductive simultaneously with tube V2. Such a condition is prevented by the provision of a suitable voltage limiting device which is connected across the ends of secondary winding 105. Such a device may be of any type suitable for the purpose and is here shown to be a two directional varistor 109.

Thus far, the description of response of the control circuit to a voltage impulse of assumed polarity has been with respect to the peak portion 22 thereof. In the event that the impulse is of sufficient amplitude, the tail portion 23 thereof also might initiate operation of the other of the control channels of the control circuit in the same manner as the peak portion 22 of the impulse initiates operation of the first of the channels. However, such condition is prevented by reason of the connection between center tap 106 of secondary winding 105 and plates 10 of tubes V2 and V3 afforded by conductor 48. Thus, as tube V2 is rendered conductive, condenser 42 is caused to discharge therethrough. Upon discharge of condenser 42, the potential at center tap 106 is reduced below the static potential thereof such that elevation of the potential at the right end of winding 105 in response to the tail portion 23 of the impulse of assumed polarity is ineffectual in elevating the potential on the low-potential side of condenser 108 above the bias potential thereon, thus preventing triggering of tube V3.

While in the foregoing a voltage impulse of polarity adapted to render tube V2 conductive has been assumed, it will be understood that, in the same manner, an impulse of opposite polarity is effectual in rendering tube V3 conductive, thus rendering tubes V2 and V3 and their associated channels selectively responsive to the polarity of the voltage impulses appearing across secondary winding 105 of transformer T3. Moreover, it should now be apparent that each of the control channels is rendered selectively responsive to the amplitude of the voltage impulse having the proper polarity for initiating operation thereof. For this purpose, resistors 53 and 54 in the discharge paths through tubes V2 and V3 respectively are selected of sufficient value so as to cause these tubes to glow whereby the operational characteristics thereof are maintained substantially constant upon repeated operation of the tubes.

By reason of the coupling provided by transformer T3 between the magnetic amplifier and the control circuit, currents which are caused to flow in the control circuit in response to application of voltage impulses thereto from the magnetic amplifier tend to render the magnetic amplifier regenerative. This regeneration is useful in increasing the sensitivity of the magnetic amplifier within controlled limits of operation thereof. Such control limits are provided by utilizing the potentials developed at cathodes 11 of tubes V2 and V3 when these tubes are rendered conductive in a manner to oppose the voltages tending to render the magnetic amplifier regenerative beyond such limits. This conveniently is accomplished in the case of tube V2 by interconnecting cathode 11 thereof and the magnetic amplifier with a resistor 110 of such value as to feed back a voltage of desired value. Similarly, cathode 11 of tube V3 is interconnected with the magnetic amplifier by means of a resistor 111.

Assuming that a voltage impulse of proper polarity to render tube V2 conductive appears at secondary winding 105 in response to movement of a vessel within the vicinity of the mine, a voltage drop is developed across resistor 53 is response to discharge of condenser 42 by way of tube V2 and resistor 53 as tube V2 conducts. This voltage drop causes the potential on the opposite side of condenser 70 to be elevated to such a value as to apply breakdown potential across the control gap of tube V4 and thus render the tube conductive. As tube V4 is rendered conductive, condenser 55 is substantially instantly discharged therethrough, resistor 59 in the discharge path thereof being of low value. Thus, tube V4 is caused to arc. Under similar operating conditions, as will appear hereinafter, tube V5 also is caused to arc. However, inasmuch as the sensitivities of tubes V4 and V5 are not critical with respect to operation of the control circuit, arcing of these tubes does not adversely affect operation of the control circuit but serves the purpose of substantially instantly elevating the cathode potentials of the tubes to the potential at tap 43 of battery 26. Such potential on cathode 11 of tube V4 is caused to decrease exponentially as condenser 55 charges through resistor 57 and resistors 112, 113 and 58 in parallel therewith.

Resistors 112, 113 and 58 comprise a voltage divider network across which the diminishing cathode voltage appears. The potential at point 114 in this divider network is applied by way of conductor 115 to a condenser 116 connected between ground and control grid 12 of tube V6, thus applying a biasing potential thereto, which, however, is not of sufficient value to break down the control gap of the tube.

One-half of the potential appearing between cathodes 11 of tubes V4 and V5 at the junction of condensers 82 and 83 is applied momentarily, as condenser 82 charges, by way of conductor 84 to control grid 12 of tube V9 thereby to apply breakdown potential across the control gap thereof and thus render the tube conductive. As tube V9 is rendered conductive, condenser 72 discharges therethrough, resistor 76 being of such value as to cause the tube to glow and to be extinguished as a voltage drop develops across the resistor.

As the potential of condenser 72 is reduced below the main gap sustaining voltage of tube V8, tube V8 is extinguished and remains extinguished for a predetermined interval of time such, for example, as 4 seconds during which condenser 72 becomes charged sufficiently to render tube V8 again conductive. During this interval the aforedescribed bias potential provided by the potential on condenser 72 for tubes V2 through V5 and V7 is removed therefrom, and, accordingly, the control circuit is rendered unresponsive to voltage impulses appearing at transformer T3, thus rendering the control circuit unresponsive to signals received from an aircraft sweep, as an aircraft will move from the vicinity of the mine within such interval.

Assuming that a second signal is received from the vessel moving with respect to the mine and assuming further that such second signal is of polarity and amplitude adapted to render tube V3 conductive, a voltage drop is developed across resistor 54 in response to discharge of condenser 42 through tube V3 and resistor 54 as the tube is rendered conductive. The voltage across resistor 54 elevates the potential on condenser 80 such that breakdown potential is applied across the control gap of tube V5, thus rendering the tube conductive. As tube V5 is rendered conductive, condenser 56 is discharged therethrough by way of resistor 59, the tube being caused to arc by reason of the low value of resistor 59 and the tube being extinguished when the potential on condenser 56 drops below the main gap sustaining potential of the tube.

As condenser 56 is recharged from battery 26, the charging current therefor passes through resistor 58 and resistors 113, 112 and 57 in parallel therewith. Resistors 113, 112 and 57 comprise a voltage divider network of which point 114 therein already has been elevated by reason of the charging current of condenser 82 which has been caused to flow through resistor 57 following arcing of tube V4, as set forth hereinbefore.

The potential at point 114, thus developed additively by the successive recharging of condensers 55 and 56, appears across condenser 116 and is applied as breakdown potential across the control gap of tube V6 thus rendering this tube conductive. As tube V6 is rendered conductive, condenser 61 is caused to discharge therethrough thus developing a voltage drop across resistor 62 which is of sufficient value to cause tube V6 merely to glow and to be extinguished as the potential of the cathode 11 thereof is elevated. Tube V6 controls complete response of the control circuit and therefore is caused to glow in order that complete response be obtained consistently under the same conditions of operation of tube V6.

The potential across resistor 62 causes the potential on condenser 90 to be elevated such that breakdown potential is applied across the control gap of tube V7, thus rendering tube V7 conductive. As tube V7 is rendered conductive, condenser 63 discharges therethrough and the discharge current is caused to flow in part through primary winding 64 of transformer T4 and in part by way of conductor 104, switch 29 of clock mechanism 27, conductor 103 and thence through fuse switch 9 of counting mechanism 31, thus causing the fuse thereof to be melted. As the fuse is melted, armature 38 of switch 9 engages contact 39 of switch 8 thereby to complete one shipcounting operation.

Winding 64 is of such impedance value as to cause tube V7 to arc, the tube being extinguished when the voltage of condenser 63 is reduced below the main gap sustaining voltage of the tube. The potential across condenser 63 also provides the plate bias potential for tubes V2 and V3 and, accordingly, these tubes are rendered non-conductive for a predetermined interval of time controlled by the time required to recharge condenser 63 from battery 26 to the potential at tap 43 thereof.

As will appear more fully hereinafter, the current flow through primary winding 64 of transformer T4 is employed to generate a voltage in the secondary winding 51 thereof for rendering tubes V2 and V3 conductive simultaneously when the time spacing between the operation of tubes V2 and V3 occurs within the "live" time of the mine. The live time of the mine is defined as the longest interval in which successive signals of opposite polarity are adapted additively to apply breakdown potential to tube V6 and thus initiate a complete operation of the control system.

Referring now to FIG. 4 in which a plurality of voltage curves is shown for the purpose of illustrating, by way of example, various operating values of the control circuit and the timing intervals thereof, curve 117 represents the voltage variation on either of condensers 55 or 56 as the condensers recharge from battery 26 following triggering of either of tubes V4 or V5 respectively. Similarly, curve 118 represents the variation in potential between the cathode 11 of either of tubes V4 and V5 and ground potential during charging of either of condensers 55 or 56 respectively. Curve 119 represents the variation in potential at point 114 in the aforedescribed voltage divider networks connected between the cathodes 11 of tubes V4 and V5 and ground potential, the variation in potential occurring during charging of either condensers 55 or 56. Horizontal line 120 represents the minimum voltage which will produce breakdown of the control gap of tube V6, and vertical line 121 represents the termination of the live time of the mine, the bias potential on tube V6 at this time, when elevated as the result of the second of tubes V4 or V5 to be fired, being just equal to the minimum voltage represented by line 120. Vertical line 122 represents the shortest interval after firing of the first of tubes V4 or V5 to be fired in which firing of the second tube will cause the first tube to be re-fired by reason of the potential developed across secondary winding 51 of transformer T4 which causes the potential of condensers 70 and 80 to be elevated such that breakdown potential is applied across the control gap of tubes V4 and V5. At this time, the potential on the cathode 11 of the first of these tubes to be fired has dropped sufficiently such that the voltage developed in secondary winding 56 of transformer T4 is sufficient for the first time to elevate the grid potential of the first tube to be fired sufficiently above the cathode potential thereof so as to apply breakdown potential therebetween.

Thus, as seen from FIG. 4, when the time spacing of a pair of signals of opposite polarity is not greater than 110 seconds, the control circuit operates to cause counting mechanism 31 to perform a counting operation corresponding to the movement of a vessel past the mine, and when the time spacing of the signals is greater than 90 seconds, the first of tubes V4 or V5 to be operated is again operated such that the condition of the control circuit is the same as when the signals are spaced by approximately 4 seconds.

Under such condition, the channels of the control circuit simultaneously become responsive to signals received by the mine from a second or succeeding vessel moving with respect thereto a predetermined interval of time after the complete operation of the control circuit. This interval of time is referred to as the intership interval or period of the mine and corresponds appproximately to the time between the movement of successive vessels past the mine. This interval, as pointed out hereinbefore, is controlled by the amount of time required for condenser 63 to charge sufficiently to develop sufficient voltage across either of resistors 53 or 54 in response to signals which render tubes V2 and V3 conductive. This interval is indicated by line 123 on FIG. 4, and is approximately 200 seconds. The voltage on condenser 63 is represented by curve 124.

The importance of the function afforded by transformer T4 will be appreciated when the condition of the control circuit is considered without use of the transformer. Assuming a time spacing of successive signals of opposite polarity which cause tubes V2 and V3 to be fired within 90 to 110 seconds of each other, 90 to 110 seconds after firing of the second of these tubes to be fired, the first of the tubes to be fired again becomes responsive to signals from the vessel which has caused these tubes to operate initially. Such a signal received at this time, being within the live time of the mine, would produce a second operation of the first of the tubes to be fired and a second complete operation of the control circuit, thereby to cause a second shipcounting operation by the same vessel.

In the event that the time spacing of the signals is less than 90 seconds, the second of tubes V2 or V3 to be fired will not be rendered responsive to signals received from the next succeeding vessel to pass the mine for some time after the first of the tubes to be fired is rendered responsive to such signals, thus extending the aforesaid 4-second interval which must elapse before the second control channel can be operated by the same vessel. This vessel, therefore, cannot be counted until the previous inter-ship interval controlled by the second control channel is terminated. Although, in such a situation, the live time of the mine for receiving signals adapted to effect a complete operation of the control circuit thereof is substantially shortened, the signatures of vessels usually encountered provide several signals of opposite polarity within the normal live period of the mine. Accordingly, the effect of such time spacing of signals on the operation of the control circuit is merely to delay the time of counting the vessels after a first signal is received therefrom and does not alter the intership interval provided between complete operations of the control circuit corresponding to the movement of successive vessels past the mine.

After a predetermined number of vessels has been counted by counting mechanism 31 as determined by the setting of wiper 36 thereof, armature 38 of switch 1 moves into engagement with contact 39 thereof, thereby to connect detonator 37 in series with the main gap of tube V7. Accordingly, upon the next complete operation of the control circuit in response to movement of the next succeeding vessel with respect to the mine, condenser 63 is discharged through the detonator thereby to fire and explode the mine as a vulnerable portion of the vessel moves adjacent thereto.

When countermining shocks, or the like, are received within the vicinity of the mine, countermining mechanism 24 operates to close switch 25 thereof, thereby to apply potential on conductor 66 to grid 12 of tube V9, thus rendering the tube conductive. As tube V9 is rendered conductive, tube V8 in turn is extinguished as condenser 72 discharges through tube V9 to a potential less than the main gap sustaining voltage of tube V8, as described in detail hereinbefore. Thus, the bias potential provided by condenser 72 for tubes V2 through V5 and V7 is removed therefrom in response to countermine shocks received by the mine, thereby to render the mine unresponsive to countermining operations for the aforesaid 4-second interval which is sufficient to allow for the subsiding of the countermine shocks.

While in the foregoing, operation of the control circuit has been assumed to be initiated by tube V2, it will be understood that operation of the circuit is adapted to be initiated by either of tubes V2 or V3 selectively in accordance with the polarity of the signals received, the aforedescribed operation of the control channels including these tubes being the same regardless of the sequence of operation thereof.

From the foregoing it should now be apparent that a mine firing control circuit has been provided which is well adapted to fulfill the aforestated objects of the invention. Moreover, while the invention has been described in particularity with respect to certain circuit arrangements which serve as a practical application of the principles of the invention, it will be apparent to those skilled in the art, after understanding the invention, that various additional circuit arrangements and variations thereof may be resorted to without departing from the spirit and scope of the invention as defined by the appended claims.

What is claimed as new and desired to be secured by Letters Patent of the United States is:

1. In a mine firing control system of the character disclosed, the combination of a mine firing control circuit including a plurality of electron discharge devices each of which is adapted to be rendered conducting when the bias voltage thereon is elevated to a predetermined value, circuit means including a first normally conducting electron discharge device for applying said bias voltage to said plurality of electron discharge devices, circuit means including a second normally non-conducting electron discharge device adapted to render said first electron discharge device non-conducting as said second electron discharge device is rendered conducting, means controlled by said mine firing control circuit for rendering said second electron discharge device conducting as the control circuit operates, and means for operating the control circuit.

2. In a mine firing control system of the character disclosed, means for generating electrical impulses of opposite polarity in accordance with the magnetic signature of a vessel moving with respect to the mine, a pair of mine firing control channels adapted to be operated selectively in accordance with the polarity of said electrical impulses, each of said channels including an electron discharge device adapted to be rendered conducting when the bias potential thereon is elevated by a predetermined amount as an impulse of proper polarity is received by the channel individual thereto, circuit means including a normally conducting electron discharge device for applying bias potential to said electron discharge devices of the control channels, circuit means including a normally non-conducting electron discharge device for rendering said normally conducting electron discharge device non-conducting as the normally non-conducting electron discharge device is rendered conducting, and means controlled by either of said control channels for causing said normally non-conducting electron discharge device to be rendered conducting as either of the control channels operates.

3. In a mine firing control system of the character disclosed, the combination of means including a pair of electron discharge devices adapted to be rendered conducting selectively in accordance with the polarity of electrical impulses applied thereto when the impulses are of sufficient amplitude to elevate the bias on the tubes to a predetermined value, means for developing additively a voltage whose value is controlled by the time spaced relation of successive operations of said pair of discharge devices, a mine firing circuit adapted to be operated by said additive voltage when the additive voltage exceeds a predetermined value, circuit means including a normally conducting electron discharge device for supplying said bias to said pair of electron discharge devices, circuit means including a normally non-conducting electron discharge device for rendering the normally conducting device non-conducting as the normally non-conducting device is rendered conducting, and means responsive to operation of either of said pair of electron discharge devices for rendering said non-conducting electron discharge device conducting.

4. In a mine firing control system of the character disclosed, the combination of a mine firing control circuit including at least one pair of static potential biased normally non-conducting electron discharge devices adapted to be rendered conductive selectively in accordance with the polarity of voltage impulses applied thereto when the amplitude of the impulses is sufficient to elevate the bias on the devices to a predetermined value above the static bias thereon and adapted to be operated successively when the impulses occur in predetermined time spaced relation, circuit means including a condenser and a normally conducting electron discharge device for charging said condenser and thereby applying said static bias potential to said pair of electron discharge devices, circuit means including a normally non-conducting electron discharge device for rendering said normally conducting device non-conducting and for discharging said condenser as the normally non-conducting device is rendered conducting, and circuit means including a device responsive to pressure impulses received through the surrounding water for rendering said normally non-conducting device conducting.

5. In a control circuit of the character disclosed, the combination of a mine firing control circuit including an electron discharge device and a bias supply circuit therefor, means including a normally conducting electron discharge device, said bias supply circuit being connected to said last named discharge device and adapted to be maintained at a constant bias potential thereby as long as the device is conducting, circuit means including a normally non-conducting electron discharge device adapted to render the normally conducting device non-conducting as the normally non-conducting device is rendered conducting, and pressure responsive means for rendering said normally non-conducting device conducting.

6. In an electrical circuit of the character disclosed, the combination of a gaseous discharge device having a cathode, an anode defining a main gap with said cathode and a control electrode defining a control gap with said cathode, a bias supply circuit connected to said anode, circuit means including a direct current source connected to said anode and control electrode for applying thereto biasing potentials sufficient to render said device conducting, the potential applied to said anode being below the breakdown potential of said main gap, a normally non-conducting electron discharge device connected to said source and in circuit with said main gap and effective when conductive to render said device non-conducting, a condenser in parallel with said normally non-conducting electron discharge device and connected in circuit with said control gap, and means for rendering said normally non-conducting electron discharge device conducting.

7. In a control circuit of the character disclosed, the combination of first and second electron discharge devices, each of said devices having a cathode, an anode defining a main gap with a cathode and a control electrode defining a control gap with the cathode, a direct current source connected across the main gap of said first device and having a potential sufficient to sustain a discharge thereacross but less than the breakdown voltage thereof, means for biasing the control electrode of said first device at a potential sufficient to initiate a discharge in the main gap thereof, a bias supply circuit connected to the anode of said first device, means including said second device for extinguishing said first device, circuit means for connecting the main gaps of said first and second devices in parallel, a condenser connected across said main gaps and also across the control gap of said first device for refiring said first device at a predetermined interval after it is extinguished by said extinguishing means, said refiring means comprising a charging circuit for said condenser including said source and a resistance connected in series therewith.

8. In a control circuit of the character disclosed, the combination of first, second, third, fourth, fifth and sixth electron discharge devices, each of said devices having a cathode, an anode defining a main gap with said cathode and a control electrode defining a control gap with said cathode, an electroresponsive detonator, a normally charged condenser, a mine firing circuit including said condenser and detonator and adapted to fire the detonator from the condenser as the first device is rendered conducting, circuit means including said second device for rendering said first device conducting as the second device is rendered conducting, circuit means for rendering said third and fourth devices conducting selectively in accordance with the polarity of electrical impulses applied to the control electrodes thereof, circuit means for rendering said fifth device conducting in response to operation of said third device, circuit means for rendering said sixth device conducting in response to operation of said fourth device, means controlled by operation of said third device for applying a voltage pulse of predetermined duration upon the control electrode of said second device, and means controlled by operation of the fourth device for applying to the control electrode of the second device a voltage pulse which is additive with respect to the voltage pulse applied thereto by said means controlled by said third device, thereby to render said second device conducting when said additive voltage exceeds a predetermined value.

9. In a control circuit of the character disclosed, the combination of first, second, third and fourth electron discharge devices, each of said devices being normally non-conducting and having a control electrode and a main gap controlled thereby, circuit means including the main gap of said first device and a transformer having a primary winding connected in series therewith and a secondary winding adapted to generate a voltage as current is caused to pass through said primary winding when the first device is rendered conducting, circuit means including said second device for applying potential to the control electrode of said first device thereby to render said first device conducting when said second device is rendered conducting, means for rendering said third and fourth devices conducting, means controlled by operation of said third device for applying a voltage pulse of predetermined duration to the control electrode of said second device, means controlled by operation of said fourth device for applying to the control electrode of said second device a voltage pulse which is additive with respect to the voltage pulse applied thereto by said third device thereby to render said second device conductive, and means controlled by the voltage generated by said secondary winding for rendering said third device again conducting when the time spacing between the operation of the third and fourth devices exceeds a predetermined value.

10. In a control circuit of the character disclosed, the combination of means including a pair of normally non-conducting electron discharge devices adapted to be rendered conducting selectively in accordance with the polarity of electrical impulses applied thereto, means for generating a voltage additively in accordance with the time spacing of operation of said pair of electron discharge devices, a normally charged condenser for providing operating bias for said electron discharge devices, a discharge circuit for said condenser controlled by said additive voltage and adapted to be rendered effective when the additive voltage exceeds a predetermined value thereby to discharge the condenser and remove the operating bias from said electron discharge devices, a source of power, a circuit for charging said condenser from the source of power, and means in said circuit to delay charging of the condenser thereby to render said devices unresponsive to said impulses for a predetermined interval of time controlled by the time required for the condenser to charge to a predetermined value corresponding to said operating bias.

11. In a control circuit of the character disclosed, the combination of a pair of electron discharge devices each having an electrode adapted to be biased to such a potential as to render the devices non-conducting, means including a normally conducting electron discharge device for applying said bias to said pair of electron discharge devices, means for elevating the bias potential on said control electrodes selectively thereby to render said pair of devices conducting, means including a normally non-conducting electron discharge device for rendering said normally conducting electron discharge device non-conducting as said non-conducting device is rendered conducting, means rendered effective as either of said pair of electron discharge devices is rendered conducting for rendering said normally non-conducting device conducting, means controlled by said pair of electron discharge devices for developing a voltage additively in accordance with the time spacing of operation of said pair of devices, and a mine firing circuit controlled by said additive voltage and adapted to be rendered effective when the additive voltage exceeds a predetermined value.

12. In a mine firing control system of the character disclosed, the combination of an inherently regenerative magnetic amplifier comprising a saturable reactor and a search coil and including a transformer having a secondary winding, said amplifier being adapted to generate voltage impulses of opposite polarity across said secondary winding in accordance with the magnetic signature of a vessel moving with respect to the mine, a control circuit including a pair of normally non-conducting electron discharge devices adapted to be rendered conductive selectively in accordance with the polarity of the voltage impulses appearing across said secondary winding, means controlled by operation of one of said devices for producing a voltage adapted to oppose to a predetermined extent regeneration of the voltage impulse which renders said device conducting, means controlled by operation of the other of said devices for producing a voltage adapted to oppose to a predetermined extent regeneration of the voltage impulse which renders said other device conductive, said control circuit being adapted to generate a voltage additively in accordance with the time spacing of operation of said devices, and a mine firing control circuit adapted to be controlled by said additive voltage and adapted to be rendered effective when the additive voltage exceeds a predetermined value.

13. In a control circuit of the character disclosed, the combination of means including a transformer having a secondary winding and adapted to generate voltage impulses of opposite polarity across said secondary winding, a pair of electron discharge devices each having a cathode, a main anode forming a main gap with the cathode and a control electrode forming a control gap with the cathode, a condenser, circuit means for connecting said condenser in parallel with said main gaps, means for applying across the control gaps of said devices bias potential of insufficient value to render said devices conducting, a second condenser interconnecting one end of said secondary winding and the electrode of one of said devices, a third condenser interconnecting the other end of said secondary winding and the control electrode of the other of said devices, said secondary winding having a center tap connected to the main anode of said devices, and a voltage limiting device connected between the ends of said secondary winding, said devices being rendered conductive selectively in accordance with the polarity of electrical impulses appearing across said secondary winding and when the impulses are of sufficient amplitude to elevate the bias potential on the devices to a predetermined value.

14. In a mine firing control system of the character disclosed, the combination of first, second, third and fourth electron discharge devices, each of said devices being normally non-conducting and having a control electrode and a main gap controlled thereby, circuit means including the main gap of said first device and a transformer having a primary winding connected in series therewith and a secondary winding adapted to generate a voltage as current is caused to pass through said primary winding when the first device is rendered conducting, circuit means including said second device for applying potential to the control electrode of said first device thereby to render said first device conducting when said second device is rendered conducting, means responsive to the magnetic signature of a vessel moving with respect to the mine for selectively rendering said third and fourth devices conducting, means controlled by operation of said third device for applying a voltage pulse of predetermined duration to the control electrode of said second device, means controlled by operation of said fourth device for applying to the control electrode of said second device a voltage pulse which is additive with respect to the voltage pulse applied thereto by said third device thereby to render said second device conductive, means controlled by the voltage generated by said secondary winding for rendering said third device again conducting when the time spacing between the operation of the third and fourth devices exceeds a predetermined value, an electroresponsive counting mechanism connected in series with the main gap of said first device and adapted to be operated thereby when the first device is rendered conducting, and an electroresponsive detonator operatively connected to said counting mechanism and adapted to be operated thereby to fire the mine when the counting mechanism has performed a predetermined number of counting operations.

15. In a mine firing control system of the character disclosed, the combination of means for generating electrical impulses of opposite polarities in accordance with the magnetic signature of a vessel moving with respect to the mine, circuit means operatively connected to said generating means and including a pair of normally non-conducting electron discharge devices adapted to be rendered conducting selectively in accordance with the polarity of electrical impulses applied thereto from said generating means, said circuit means being adapted to generate a voltage additively in accordance with the time spacing of operation of said pair of electron discharge devices, a normally charged condenser for providing operating bias for said electron discharge devices, a discharge circuit for said condenser controlled by said additive voltage and adapted to be rendered effective when the additive voltage exceeds a predetermined value thereby to discharge the condenser and remove the operating bias from said electron discharge devices, a source of power, a circuit for charging said condenser from the source of power and adapted to delay charging of the condenser thereby to render said devices unresponsive to said impulses for a predetermined interval of time controlled by the time required for the condenser to charge to a predetermined value corresponding to said operating bias, an electroresponsive ship counting mechanism arranged to be operated by the energy discharged from said condenser, and an electroresponsive detonating means arranged to be fired by the energy discharged from said condenser when the ship counter has performed a predetermined number of counting operations.

16. In a mine firing control system of the character disclosed, the combination of a pair of normally non-conducting electron discharge devices each having a cathode, an anode defining a main gap with said cathode and a control electrode defining a control gap with said cathode, circuit means for connecting the main gap of said devices in parallel, a normally charged condenser connected in parallel with said main gaps and adapted to be discharged through either of the gaps as either of the devices individual thereto is rendered conductive, means including a transformer having a secondary winding for generating across the secondary winding a voltage impulse having successive positive and negative values in accordance with the magnetic signature of a vessel moving with respect to the mine, means for applying across the control gaps of said devices fixed bias potential of insufficient value to render said devices conducting, circuit means including one end of said secondary winding and connected across the anode and control electrode of one of said devices for elevating the bias potential thereon to a value rendering said device conducting in response to the positive value of the impulse appearing across said secondary winding, circuit means including the other end of said secondary winding and connected across the main anode and control electrode of the other of said devices for depressing the bias potential thereon in response to the positive value of said electrical impulse, the potential of said condenser serving as a reference voltage for said electrical impulse whereby the negative value thereof is suppressed upon discharge of the condenser as one of said devices is rendered conductive in response to the positive value of the impulse thereby to prevent operation of the other of said devices in response to the negative value of the impulse, circuit means controlled by said electron discharge devices for developing additively a voltage whose value is controlled by the time spaced relation of successive operations of the devices, and a mine firing circuit operatively connected to said last named circuit means and arranged to be operated by said additive voltage when the additive voltage reaches a predetermined value.

17. In a mine firing control system of the character disclosed, the combination of means including a transformer having a secondary winding and adapted to generate voltage impulses of opposite polarity across said secondary winding in accordance with the magnetic signature of a vessel moving with respect to the mine, a pair of electron discharge devices each having a cathode, a main anode forming a main gap with the cathode and a control electrode forming a control gap with the cathode, a condenser, circuit means for connecting said condenser in parallel with said main gaps, means for applying across the control gaps of said devices bias potential of insufficient value to render said devices conducting, a second condenser interconnecting one end of said secondary winding and the electrode of one of said devices, a third condenser interconnecting the other end of said secondary winding and the control electrode of the other of said devices, said secondary winding having a center tap connected to the main anode of said devices, a voltage limiting device connected between the ends of said secondary winding, said devices being rendered conductive selectively in accordance with the polarity of electrical impulses appearing across said secondary winding and when the impulses are of sufficient amplitude to elevate the bias potential on the devices to a predetermined value, circuit means controlled by said electron discharge devices for developing additively a voltage whose value is controlled by the time spaced relation of successive operations of the devices, and a mine firing circuit operatively connected to said last named circuit means and arranged to be operated by said additive voltage when the additive voltage reaches a predetermined value.

* * * * *